US007165631B2

(12) United States Patent
Chang

(10) Patent No.: US 7,165,631 B2
(45) **Date of Patent: *Jan. 23, 2007**

(54) PNEUMATIC WRENCH HAVING ENHANCED STRENGTH

(76) Inventor: Hsin Ho Chang, No. 283, Guangfu Rd., Situn District, Taichung City (TW) 407

( * ) Notice: Subject to any disclaimer, the term of this patent is extended or adjusted under 35 U.S.C. 154(b) by 150 days.

This patent is subject to a terminal disclaimer.

(21) Appl. No.: 10/895,207

(22) Filed: Jul. 19, 2004

(65) Prior Publication Data

US 2006/0011364 A1 Jan. 19, 2006

(51) Int. Cl.
*B25D 15/00* (2006.01)

(52) U.S. Cl. ..... 173/104; 173/93; 173/93.5

(58) Field of Classification Search ..... 173/104, 173/93, 93.5, 93.6, 125, 126; 81/465, 466
See application file for complete search history.

(56) References Cited

U.S. PATENT DOCUMENTS 2,580,631 A * 1/1952 Whitledge ..... 173/93.5
2,802,556 A * 8/1957 Schmid ..... 173/93.5
3,661,217 A * 5/1972 Maurer ..... 173/93.5
4,287,956 A * 9/1981 Maurer ..... 173/93.5
4,321,973 A * 3/1982 Maurer ..... 173/93.5
5,941,319 A * 8/1999 Juan ..... 173/93.5
6,024,180 A * 2/2000 Lin ..... 173/93.5
6,070,674 A * 6/2000 Williamson et al. ..... 173/1
6,454,020 B1 * 9/2002 Jong ..... 173/93
6,491,111 B1 * 12/2002 Livingston et al. ..... 173/93.5
2005/0145401 A1 * 7/2005 Chang ..... 173/93.5
2006/0011363 A1 * 1/2006 Chang ..... 173/93.5

* cited by examiner

*Primary Examiner*—Sameh H. Tawfik
*Assistant Examiner*—Brian Nash
(74) *Attorney, Agent, or Firm*—Banger Shia

(57) ABSTRACT

A pneumatic wrench includes a pneumatic motor, a striking portion, and a drive shaft. The striking portion includes a support seat, a first hammer, and a second hammer. Thus, the first hammer and the second hammer are driven by the fixed pins and the movable pins of the support seat respectively, thereby preventing the fixed pins and the movable pins from being worn out or broken due to a stress concentration so as to increase the lifetime of the pneumatic wrench. In addition, the connecting rib is located between and connected to the first driven block and the second driven block of the drive shaft so as to enhance the structural strength of the drive shaft.

7 Claims, 8 Drawing Sheets

PNEUMATIC WRENCH HAVING ENHANCED STRENGTH

BACKGROUND OF THE INVENTION

1. Field of the Invention

The present invention relates to a pneumatic wrench, and more particularly to a pneumatic wrench having an enhanced structural strength to withstand a larger torque.

2. Description of the Related Art

A conventional pneumatic wrench in accordance with the prior art shown in FIGS. 6–8 comprises a pneumatic motor 10, a striking portion 20, and a drive shaft 30. The striking portion 20 is driven by the pneumatic motor 10 to rotate in the normal direction and the reverse direction to drive the drive shaft 30 to rotate, so that the drive shaft 30 is rotated to rotate a socket (not shown) mounted on the drive shaft 30 so as to drive and rotate a screw member, such as a bolt, nut or the like.

The pneumatic motor 10 includes a cylinder 11, a vane 12 mounted in the cylinder 11, a rotor 15 mounted in the cylinder 11, and a toothed shaft 16 mounted on and protruded outward from the rotor 15.

The striking portion 20 includes a support seat 21 having a first end face formed with a toothed hole 22 engaged with the toothed shaft 16 of the pneumatic motor 10 and a second end face formed with a through hole 23 for mounting the drive shaft 30, a first hammer 26 mounted in the support seat 21, and a second hammer 28 mounted in the support seat 21. The support seat 21 of the striking portion 20 has two opposite side walls formed with two mounting holes 24 for mounting two pins 25. The first hammer 26 and the second hammer 28 are fixed in the support seat 21 by the pins 25. Thus, the first hammer 26 and the second hammer 28 are driven by the pins 25. In addition, the first hammer 26 is formed with a first locking hole 27, and the second hammer 28 is formed with a second locking hole 29 located opposite to the first locking hole 27, so that the first hammer 26 and the second hammer 28 co-operate to drive the drive shaft 30 to rotate in the normal direction and the reverse direction.

The drive shaft 30 has a first end mounted in the support seat 21 of the striking portion 20 and formed with an engaging portion 35 engaged with the first hammer 26 and the second hammer 28 and a second end formed with a mounting portion 31 for mounting a socket (not shown). The engaging portion 35 of the drive shaft 30 has a first end formed with a first driven block 36 mounted in the first locking hole 27 of the first hammer 26 and a second end formed with a second driven block 37 mounted in the second locking hole 29 of the second hammer 28.

In operation, after the compressed air enters the cylinder 11 of the pneumatic motor 10, the vane 12 and the rotor 15 are operated to rotate the toothed shaft 16 which rotates the support seat 21, so that the support seat 21 of the striking portion 20 is rotated in the normal direction and the reverse direction to move the pins 25 to move the first hammer 26 and the second hammer 28 which are driven to strike the first driven block 36 and the second driven block 37 of the drive shaft 30 respectively, so as to drive the drive shaft 30 to rotate. Thus, the drive shaft 30 is rotated to rotate the socket (not shown) mounted on the mounting portion 31 of the drive shaft 30 so as to drive and rotate a screw member, such as a bolt, nut or the like.

However, both of the first hammer 26 and the second hammer 28 which are driven by the pins 25, so that the pins 25 are easily worn out or broken due to a stress concentration, thereby decreasing the lifetime of the conventional pneumatic wrench. In addition, the first driven block 36 and the second driven block 37 of the drive shaft 30 are respectively hit by the first hammer 26 and the second hammer 28 of the striking portion 20 constantly, so that the engaging portion 35 of the drive shaft 30 is easily worn out or broken during a long-term utilization.

SUMMARY OF THE INVENTION

The present invention is to mitigate and/or obviate the disadvantage of the conventional pneumatic wrench.

The primary objective of the present invention is to provide a pneumatic wrench having an enhanced structural strength to withstand a larger torque.

Another objective of the present invention is to provide a pneumatic wrench, wherein the first hammer and the second hammer are driven by the fixed pins and the movable pins of the support seat respectively, thereby preventing the fixed pins and the movable pins from being worn or broken due to a stress concentration so as to increase the lifetime of the pneumatic wrench.

A further objective of the present invention is to provide a pneumatic wrench, wherein the connecting rib is located between and connected to the first driven block and the second driven block so as to enhance the structural strength of the engaging portion of the drive shaft.

A further objective of the present invention is to provide a pneumatic wrench, wherein the fixed pins and the movable pins of the support seat withstand a larger reaction applied on the first hammer and the second hammer during the striking action, thereby greatly enhancing the structural strength and the lifetime of the pneumatic wrench.

In accordance with one embodiment of the present invention, there is provided a pneumatic wrench, comprising a striking portion including a support seat having two end faces, a first hammer mounted in the support seat, and a second hammer mounted in the support seat, wherein:

the support seat of the striking portion has two opposite side walls each having an inner face formed with an insertion hole for mounting a fixed pin and a movable pin juxtaposed to each other; and the first hammer and the second hammer are fixed in the support seat by the fixed pins and the movable pins of the two opposite side walls of the support seat.

Further benefits and advantages of the present invention will become apparent after a careful reading of the detailed description with appropriate reference to the accompanying drawings.

DETAILED DESCRIPTION OF THE INVENTION

Figure 1:
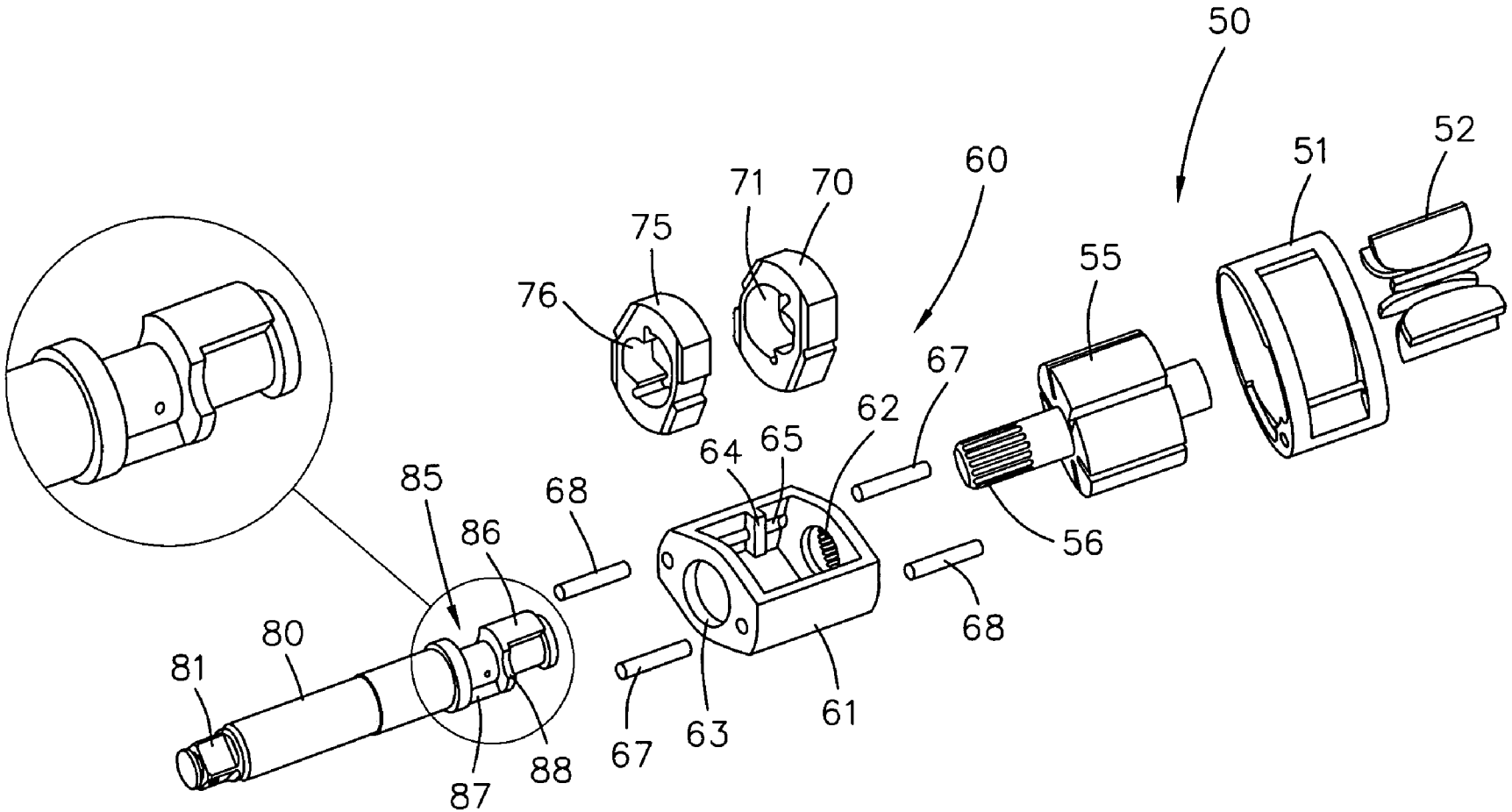
FIG. 1 is an exploded perspective view of a pneumatic wrench in accordance with the preferred embodiment of the present invention.

Referring to the drawings and initially to FIGS. 1–4, a pneumatic wrench in accordance with the preferred embodiment of the present invention comprises a pneumatic motor 50, a striking portion 60, and a drive shaft 80. The striking portion 60 is driven by the pneumatic motor 50 to rotate in the normal direction and the reverse direction to drive the drive shaft 80 to rotate, so that the drive shaft 80 is rotated to rotate a socket (not shown) mounted on the drive shaft 80 so as to drive and rotate a screw member, such as a bolt, nut or the like.

The pneumatic motor 50 includes a cylinder 51, a vane 52 mounted in the cylinder 51, a rotor 55 mounted in the cylinder 51, and a toothed shaft 56 mounted on and protruded outward from the rotor 55.

The striking portion 60 includes a support seat 61 having a first end face formed with a toothed hole 62 engaged with the toothed shaft 56 of the pneumatic motor 50 and a second end face formed with a through hole 63 for mounting the drive shaft 80, a first hammer 70 mounted in the support seat 61, and a second hammer 75 mounted in the support seat 61. Preferably, the through hole 63 of the support seat 61 is co-axial with the toothed hole 62 of the support seat 61.

The support seat 61 of the striking portion 60 has two opposite side walls each having an inner face formed with an insertion hole 65 for mounting a fixed pin 67 and a movable pin 68 juxtaposed to each other. The insertion hole 65 of each of the two opposite side walls of the support seat 61 has two distal ends extended to and through the first and second end faces of the support seat 61 respectively.

The inner face of each of the two opposite side walls of the support seat 61 has a mediate portion formed with a spacer 64, and the insertion hole 65 is extended through the spacer 64.

The first hammer 70 and the second hammer 75 are fixed in the support seat 61 by the fixed pins 67 and the movable pins 68 of the two opposite side walls of the support seat 61 and are separated by the spacers 64 of the two opposite side walls of the support seat 61. Thus, the first hammer 70 and the second hammer 75 are driven by the fixed pins 67 and the movable pins 68 of the two opposite side walls of the support seat 61. In addition, the first hammer 70 is formed with a first locking hole 71, and the second hammer 75 is formed with a second locking hole 76 located opposite to the first locking hole 71, so that the first hammer 70 and the second hammer 75 co-operate to drive the drive shaft 80 to rotate in the normal direction and the reverse direction.

Figure 5:
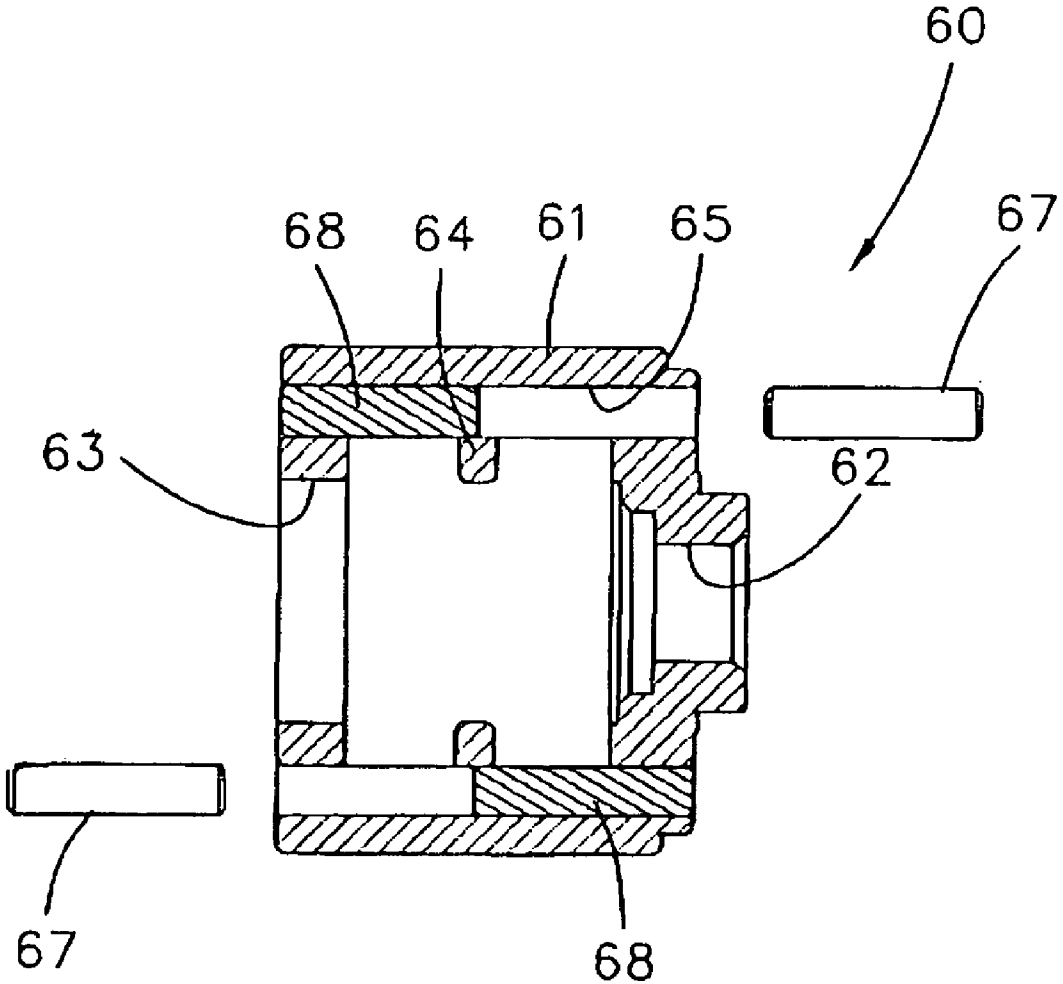
FIG. 5 is a partially plan cross-sectional assembly view of the pneumatic wrench as shown in FIG. 1.
Figure 6:
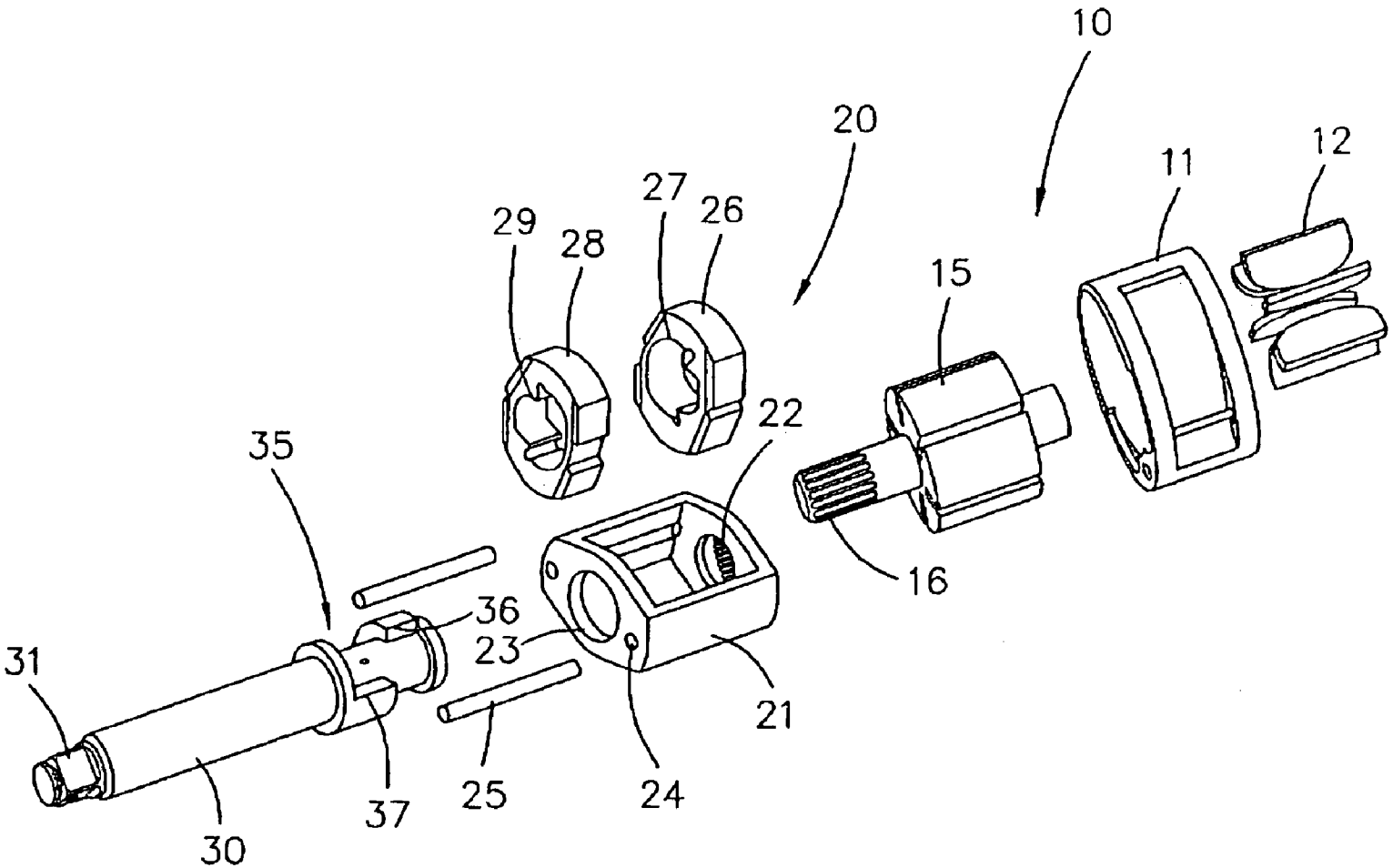
FIG.6 PRIOR ART
FIG. 6 is an exploded perspective view of a conventional pneumatic wrench in accordance with the prior art.
Figure 7:
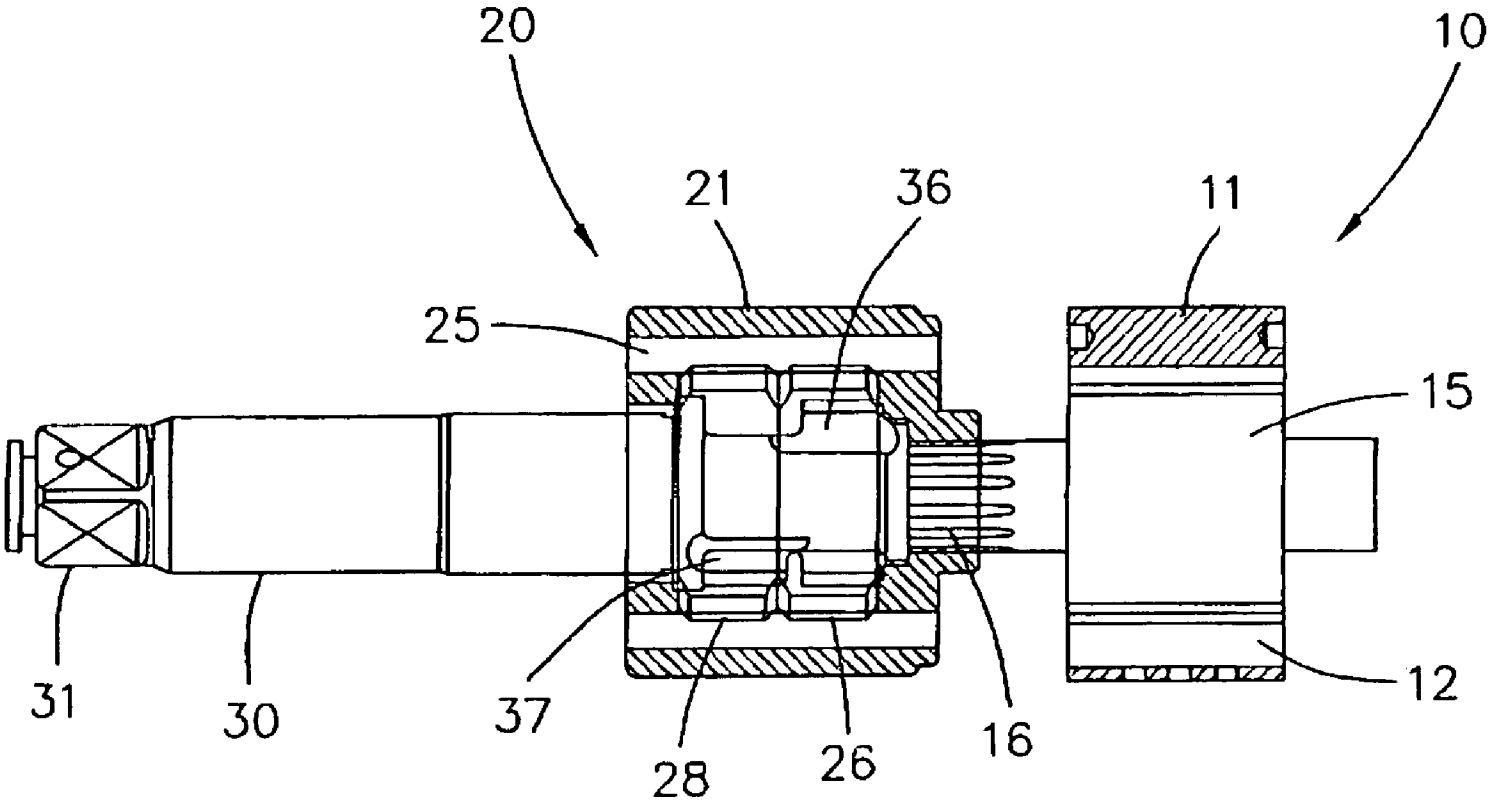
FIG.7 PRIOR ART
FIG. 7 is a plan cross-sectional assembly view of the conventional pneumatic wrench as shown in FIG. 6.
Figure 8:
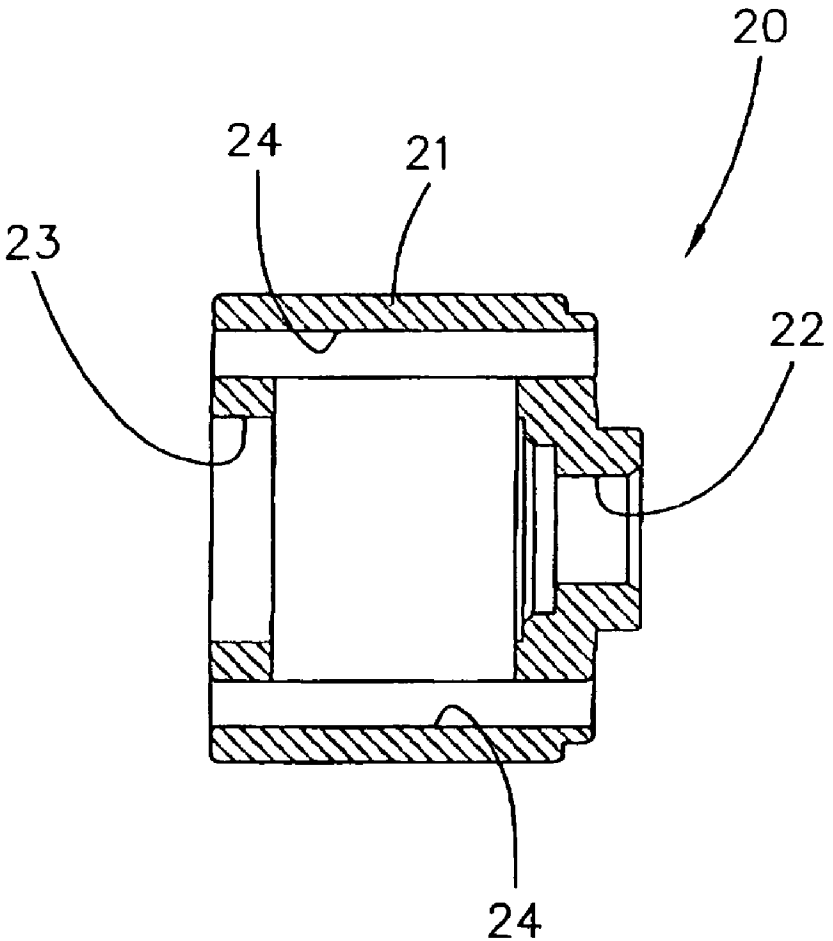
FIG.8 PRIOR ART
FIG. 8 is a partially plan cross-sectional view of a striking portion of the conventional pneumatic wrench as shown in FIG. 6.

As shown in FIG. 5, the fixed pin 67 and the movable pin 68 of one of the two opposite side walls of the support seat 61 is located opposite to the movable pin 68 and the fixed pin 67 of the other one of the two opposite side walls of the support seat 61. In addition, the fixed pin 67 and the movable pin 68 of each of the two opposite side walls of the support seat 61 are located between the spacer 64 and the first and second end faces of the support seat 61.

Figure 2:
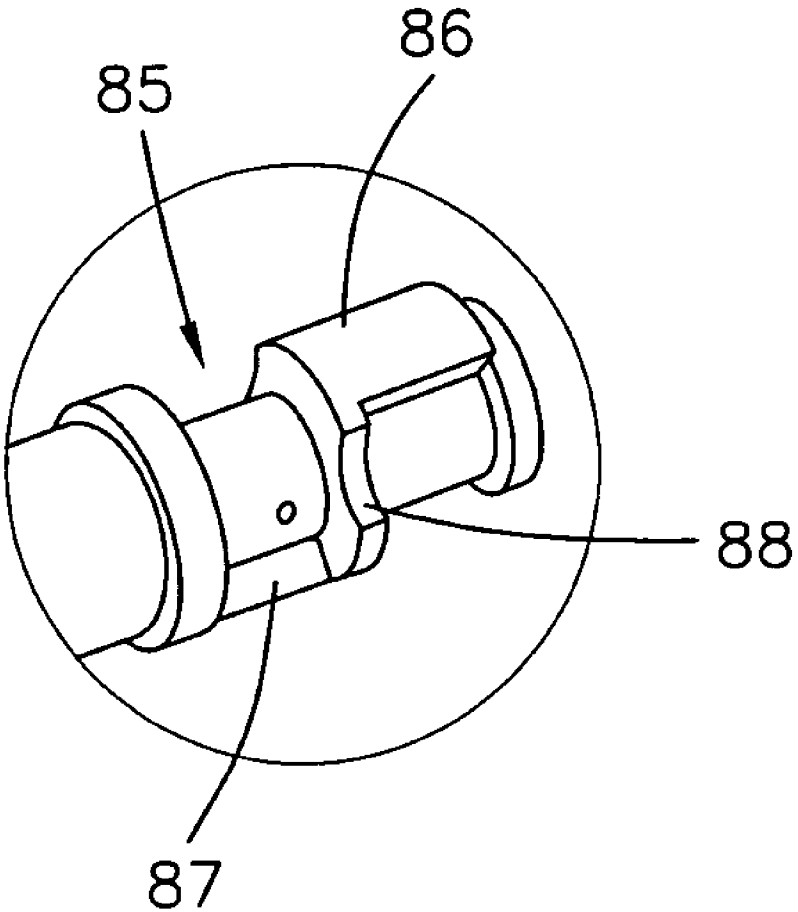
FIG. 2 is a partially enlarged view of a drive shaft of the pneumatic wrench as shown in FIG. 1.
Figure 3:
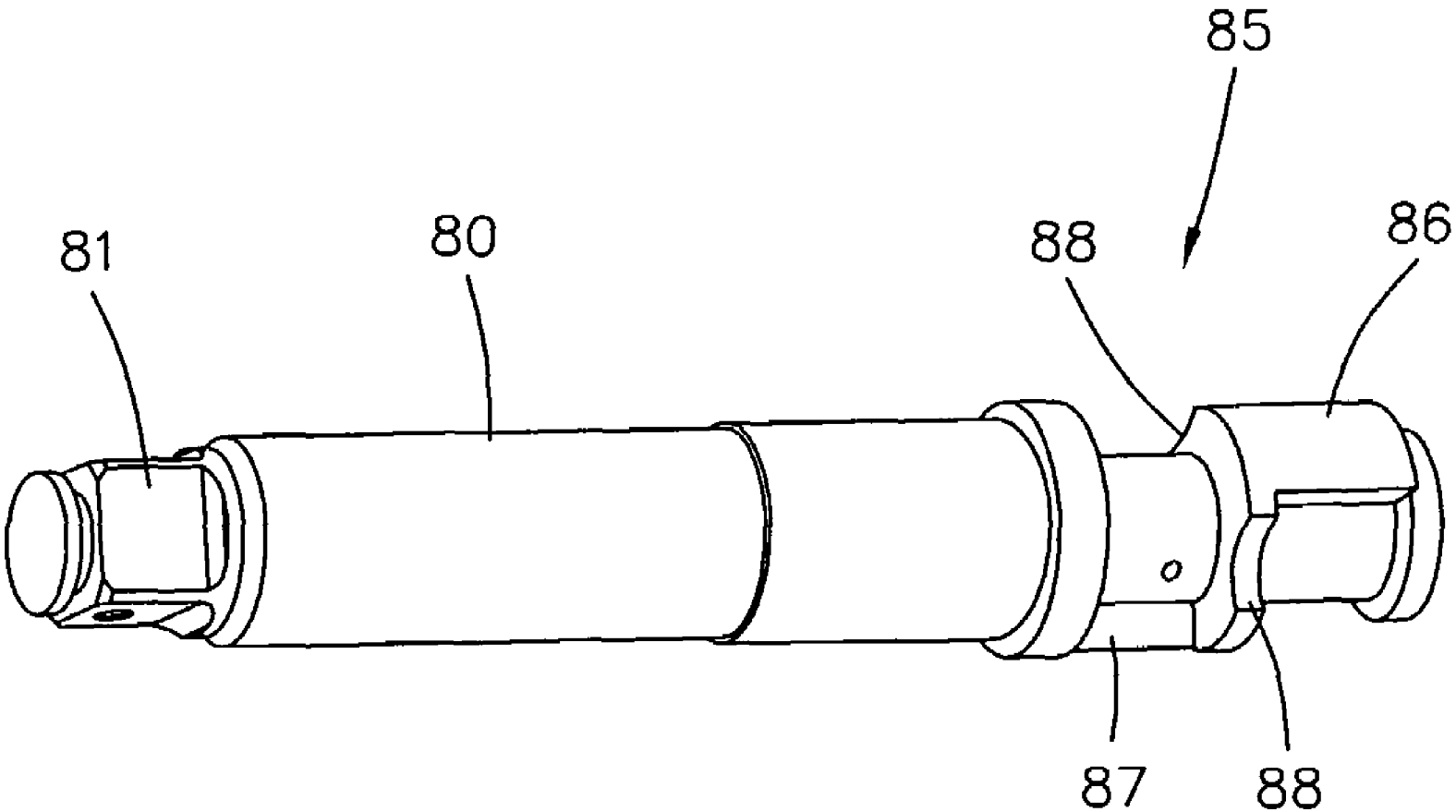
FIG. 3 is a partially enlarged view of the drive shaft of the pneumatic wrench as shown in FIG. 1.
Figure 4:
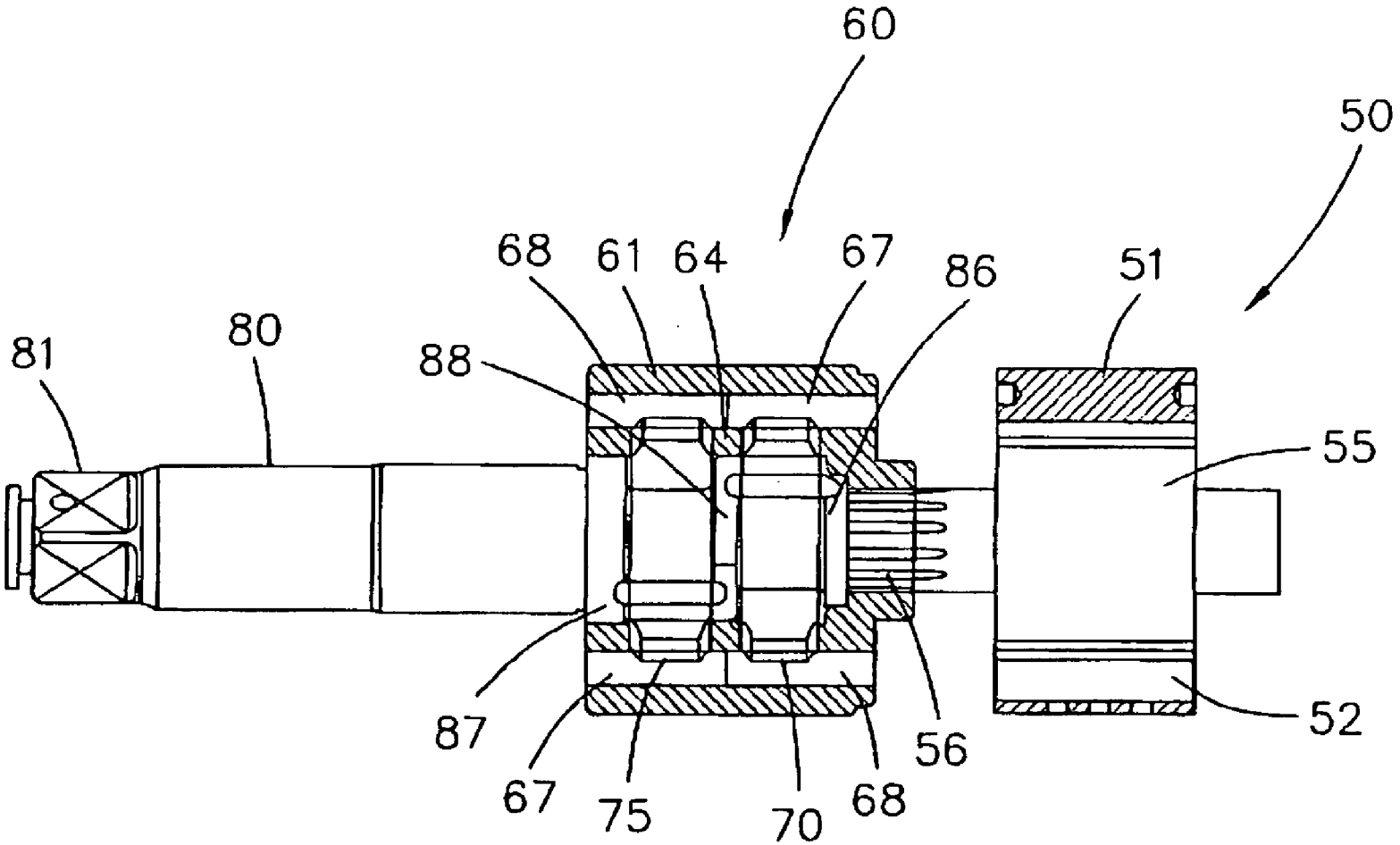
FIG. 4 is a plan cross-sectional assembly view of the pneumatic wrench as shown in FIG. 1.

As shown in FIGS. 1–3, the drive shaft 80 has a first end mounted in the support seat 61 of the striking portion 60 and formed with an engaging portion 85 engaged with the first hammer 70 and the second hammer 75 and a second end formed with a mounting portion 81 for mounting a socket (not shown).

The engaging portion 85 of the drive shaft 80 has a first end formed with a first driven block 86 mounted in the first locking hole 71 of the first hammer 70, a second end formed with a second driven block 87 mounted in the second locking hole 76 of the second hammer 75, and a mediate portion formed with a connecting rib 88 located between and connected to the first driven block 86 and the second driven block 87 to enhance the structural strength of the engaging portion 85 of the drive shaft 80.

In operation, referring to FIGS. 1–5, after the compressed air enters the cylinder 51 of the pneumatic motor 50, the vane 52 and the rotor 55 are operated to rotate the toothed shaft 56 which rotates the support seat 61, so that the support seat 61 of the striking portion 60 is rotated in the normal direction and the reverse direction to move the fixed pins 67 and the movable pins 68 to move the first hammer 70 and the second hammer 75 which are driven to strike the first driven block 86 and the second driven block 87 of the drive shaft 80 respectively, so as to drive the drive shaft 80 to rotate. Thus, the drive shaft 80 is rotated to rotate the socket (not shown) mounted on the mounting portion 81 of the drive shaft 80 so as to drive and rotate a screw member, such as a bolt, nut or the like.

Accordingly, the first hammer 70 and the second hammer 75 are driven by the fixed pins 67 and the movable pins 68 of the support seat 61 respectively, thereby preventing the fixed pins 67 and the movable pins 68 from being worn or broken due to a stress concentration so as to increase the lifetime of the pneumatic wrench. In addition, the connecting rib 88 is located between and connected to the first driven block 86 and the second driven block 87 so as to enhance the structural strength of the engaging portion 85 of the drive shaft 80. Further, the fixed pins 67 and the movable pins 68 of the support seat 61 withstand a larger reaction applied on the first hammer 70 and the second hammer 75 during the striking action, thereby greatly enhancing the structural strength and the lifetime of the pneumatic wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pneumatic wrench, comprising a striking portion including a support seat having two end faces, a first hammer mounted in the support seat, and a second hammer mounted in the support seat, wherein:

the support seat of the striking portion has two opposite side walls each having an inner face formed with an insertion hole for mounting two pins juxtaposed to each other; and the first hammer and the second hammer are fixed in the support seat by the two pins of the two opposite side walls of the support seat.

2. The pneumatic wrench in accordance with claim 1, wherein the insertion hole of each of the two opposite side walls of the support seat has two distal ends extended to and through the two end faces of the support seat respectively.

3. The pneumatic wrench in accordance with claim 1, wherein the inner face of each of the two opposite side walls of the support seat has a mediate portion formed with a spacer.

4. The pneumatic wrench in accordance with claim 3, wherein the insertion hole of each of the two opposite side walls of the support seat is extended through the respective spacer.

5. The pneumatic wrench in accordance with claim 3, wherein the first hammer and the second hammer are separated by the spacers of the two opposite side walls of the support seat.

6. The pneumatic wrench in accordance with claim 1, wherein the first hammer and the second hammer are driven by the two pins of the two opposite side walls of the support seat.

7. The pneumatic wrench in accordance with claim 1, further comprising a drive shaft having an end mounted in the support seat of the striking portion and formed with an engaging portion engaged with the first hammer and the second hammer, wherein:

the engaging portion of the drive shaft has a first end formed with a first driven block mounted in the first hammer, a second end formed with a second driven block mounted in the second hammer, and a mediate portion formed with a connecting rib located between and connected to the first driven block and the second driven block.

* * * * *